United States Patent [19]

Abe

[11] Patent Number: 4,943,258

[45] Date of Patent: Jul. 24, 1990

[54] OUTLET DEVICE FOR COIN PAYOUT HOPPERS

[75] Inventor: Hiroshi Abe, Tokyo, Japan

[73] Assignee: Asahi Seiko Kabushiki Kaisha, Japan

[21] Appl. No.: 250,092

[22] Filed: Sep. 28, 1988

[30] Foreign Application Priority Data

Oct. 3, 1987 [JP] Japan ..... 62-151784[U]

[51] Int. Cl.[5] ..... G07D 9/04

[52] U.S. Cl. ..... 453/30; 453/50; 221/267

[58] Field of Search ..... 194/334, 337, 338, 344, 194/347, 203; 453/30, 32, 39, 40, 49, 50, 57; 221/267; 379/150, 151, 152, 153

[56] References Cited

U.S. PATENT DOCUMENTS

| | | | |
|---|---|---|---|
| 1,470,747 | 10/1923 | Juley | 379/150 |
| 2,014,506 | 9/1935 | Patche | 194/338 |
| 2,734,680 | 2/1956 | Jones | 194/344 X |
| 3,837,454 | 9/1974 | Joeck | 194/344 X |
| 4,437,478 | 3/1984 | Abe | 453/32 |
| 4,518,001 | 5/1985 | Branham | 221/267 X |
| 4,592,377 | 6/1986 | Paulsen et al. | 453/33 |

*Primary Examiner*—F. J. Bartuska

*Attorney, Agent, or Firm*—Arnold, White & Durkee

[57] ABSTRACT

An outlet device for coin payout hoppers including an outlet chute having a curved coin guiding passage for receiving coins at a lower inlet in the horizontal direction form the coin payout hopper and guiding the coins in the vertical direction and an escalator connected to the outlet chute at the lower end. The outlet chute includes a back side plate and a pair of edge plates to drop a deformed coin out of the curved passage to prevent a coin from jamming in the passages of the outlet chute and the escalator. Further, the escalator includes a coin holding device on the front side plate having an opening for preventing a coin from descending by a wedge action to decrease the weight of upper coins subjected to lower coins, to thereby provide an outlet device having a high lift and high efficiency without coin jamming.

5 Claims, 6 Drawing Sheets

OUTLET DEVICE FOR COIN PAYOUT HOPPERS

BACKGROUND OF THE INVENTION

1. Field of the Invention

The present invention relates to an outlet device for coin payout hoppers used in game machines, coin exchangers or the like.

2. Related Art Statement

Hitherto, there is a coin payout hopper as described in U.S. Pat. No. 4,437,478 comprising a hopper for storing coins, a rotary disc rotatably mounted within said hopper at an angle to the horizontal, a plurality of delivery pins spaced in the peripheral direction of the rotary disc, and a delivery knife for guiding coins at an upper delivery portion to a discharge chute.

Some coin payout hoppers of the type mentioned above are provided with an outlet device which comprises an outlet chute for receiving coins discharged from the discharge chute of the coin payout hopper and an escalator which is connected to the outlet chute at the lower end thereof and upwardly extended from the outlet chute for transferring coins to a coin tray which is elevated from the hopper as described in U.S. Pat. No. 4,518,001.

The escalator is in the form of an elongated trough composed of front and back side plates and a pair of edge plates interposed between the side edges of the side plates, respectively, to define an upwardly extending, straight coin guide passage adapted for pushing up coins in single, edge-to-edge file or stack in the trough to the upper outlet end thereof by mutual thrust of coins pushed into the outlet chute, for example, by means of the delivery pins of the coin payout hopper.

In the conventional outlet device, as shown in FIGS. 9 and 10, the outlet chute 1 is composed of front and back side plates 7 and 8 and edge plates 11 and 12 interposed between the side plates to define a curved coin guiding passage 4 extending from a lower inlet 3 receiving coins 2 from a discharge chute of a payout hopper to an upper outlet 5 connected to the lower end of an elevator 6. The curved coin guiding passage has a depth between the front and back plates greater than the thickness of the coins, but less than twice the thickness of the coins and a width between the edge plates also greater than the diameter of the coins. The width of the curved coin guiding passage is defined by the opposed coin guiding edge faces 9 and 10 of the edge plates 11 and 12 positioned in the outer and inner side in relation to a center of curvature of the curved guiding passage 4, respectively. The front side plate 7 in the case shown in FIGS. 9 and 10 is divided to an inner front side plate 7A and an outer front side plate 7B which are spaced to define a window 13 extending along the curved coin passage 4. The inner and outer front side plates 7A and 7B are rigidly secured to the back side plate 8 together with the edge plates 11 and 12 by means of screws 14 and 15. The outer and inner front side plates 7A and 7B have extensions *7a* and *7b* beyond the coin guiding edge face 9 and 10 of the edge plate 11 and 12, respectively, to provide gutters for engaging with the outer pripheral portion of the coins to retain the coins in the curved guiding passage and to prevent the coins from dropping out of the passage. Thus, the outlet chute 1 receives coins 2 pushed in the lower inlet 3 in the horizontal direction as shown by an arrow "A" and guides them in single, edge-to-edge file in the curved guiding passage 4 defined by the front side plate 8, a pair of the edge plates 11 and 12 and both the front side plates 7A and 7B towards the upper outlet 5 in the vertical direction as shown by an arrow "B" by a mutual thrust of coins.

Such a conventional outlet device as mentioned above has drawbacks such that a deformed coin can be jammed in the guiding passage by outwardly or inwardly pushing by an edge of the adjacent coin slipping behind or in front of the deformed coin against the side plates to stop up the coins in the guiding passage. Particularly, when the height of the escalator is higher, the weight of coins subjected to the coins in the curved guiding passage is larger. As the result, the tendency of jamming by the deformed coin is increased. Accordingly, not only is the height of the escalator limited, but also the efficiency of payout is decreased.

SUMMARY OF THE INVENTION

An object of the invention is to remove the drawbacks mentioned above and to provide an outlet device having a high lift and high efficiency without jamming of coins.

According to the present invention, the outlet device for coin payout hoppers comprises an outlet chute having a curved coin guiding passage for upwardly guiding coins pushed in a lower inlet in the horizontal direction towards an upper outlet in the vertical direction and an escalator connected to the outlet chute at the lower end thereof and composed of opposite side plates and edge plates interposed between the side edges of the side plates to define a coin guide passage upwardly extending from the upper outlet of the curved guiding passage of the outlet chute. The outlet chute is composed of a back side plate, a pair of inner and outer edge plates secured to the opposite edge portions of the back side plate so as to space the opposed coin guiding edge faces of the edge plates apart from each other by distance corresponding to a diameter of the coin to be handled, and a front side plate covering only the inner edge plate positioned in the inner side in relation to a center of curvature of the curved coin guiding passage, which has an extension protruding beyond the inner coin guiding edge face of the inner edge plate. At least the edge face of the outer edge plate, positioned in the outer side in relation to the center of curvature, is inclined to the back side plate at an angle $\theta$. The above-mentioned arrangement of the outlet chute permits a deformed coin to drop out of the curved guiding passage when the deformed coin is, for example, outwardly pushed by the edge of an adjacent coin which slips in front of or behind the deformed coin which might otherwise jam against the side plates to clog the guiding passage.

In an embodiment of the invention for more effectively dropping the deformed coin from the curved guiding passage of the outlet chute to completely prevent any slightly deformed coins from passing into the guiding passage, the escalator is composed of the front and back plates and a pair of edge plates. In this embodiment, the outlet chute is composed of a back side plate and a pair of edge plates each of which has a coin guiding edge face inclined to the back side plate. The outer guide plate is rigidly fixed to the back side plate, while the inner edge plate is rotatably pivoted to the back side plate at the inner end thereof and is connected to the fixed outer guide plate by means of a tension spring secured to the outer portion of the movable inner edge plate.

In a further embodiment of the invention for increasing the coin lifting height of the escalator, the front side plate having a window is provided with means for holding coins at their pushed-up position in the trough to prevent the coins from descending when the feeding out operation of the payout hopper is stopped. The coin holding means includes a ball retaining gutter which has a sloped guide wall extending along the trough at an acute angle $\alpha$ such as 8°–15° to the front side plate. The coin holding means also includes a coin holding ball which is vertically movably retained in the ball retaining gutter and protrudes from the opening of the ball retaining gutter into the coin guiding passage to contact the side surface of the coin in the coin guiding passage. The coin holding ball holds the coin by a wedging effect of the ball moved downwardly in the tapered guide gutter when the coin tends to descend in the coin guiding passage.

In a further embodiment of the invention for efficiently feeding coins from the upper end outlet of the coin guiding passage, the escalator comprises an upper end outlet upwardly opened at the top end of the coin guiding passage; a coin pushing out roller provided at an upper end of a supporting lever pivoted at one side of the passage and resiliently urged toward the center of the upper end outlet; means for latching the roller supporting lever in the closed position of the roller; an electromagnetic solenoid for releasing the latching means upon operating the payout hopper, and a counter actuated by the roller supporting lever.

DESCRIPTION OF THE PREFERRED EMBODIMENTS

The present invention will be more fully described with reference to FIGS. 1–8.

Figure 1:
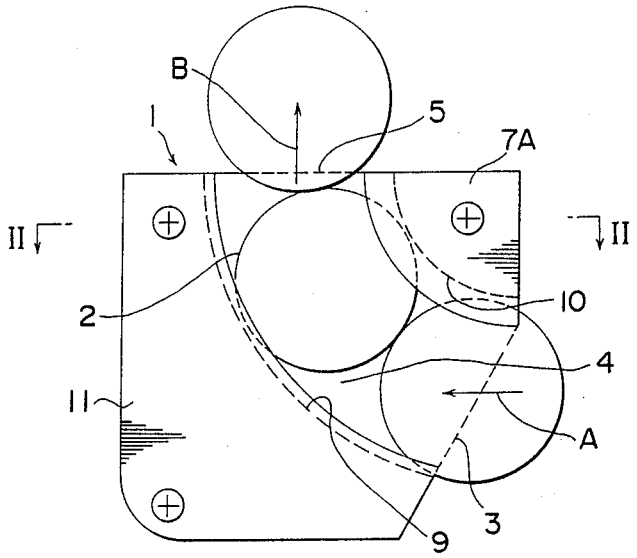
FIG. 1 is an elevational view of a first embodiment of the outlet chute of the outlet device according to the present invention.
Figure 2:
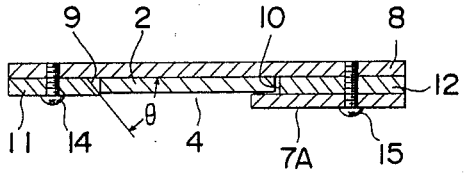
FIG. 2 is a cross-sectional view taken on the line II—II in FIG. 1.

Referring to FIGS. 1 and 2 illustrating the first embodiment, an outlet chute 1 of an outlet device is generally arranged such as to receive coins 2 pushed in a lower inlet 3 in the horizontal direction as shown by an arrow "A" from a coin payout hopper and guide the coins in single edge-to-edge file in a curved coin guiding passage 4 to convert the coin in the vertical direction towards an upper outlet 5 as shown by an arrow "B". The upper outlet 5 is connected to the lower end of an escalator of the outlet device.

As shown in FIG. 2, an outer edge plate 11 which has an outer coin guiding edge face 9 positioned at the outer side in relation to a center of curvature of the curved coin guiding passage 4 is fixedly secured to a back side plate 8 by means of screws 14 and an inner edge plate 12 which has an inner coin guiding edge face 10 positioned at the inner side in relation to the center of curvature of the curved coin guiding passage 4 is fixedly secured to the back side plate 8 together with a inner front side plate 7A by means of a screw 15. The inner front side plate 7A has an extension **7*a* protruding beyond the inner edge face 10**.

The outer edge face 9 is inclined to the back side plate 8 at an acute angle $\theta$ of about 70° without any means for preventing the coins from dropping out of the curved coin guide passage.

Figure 3:
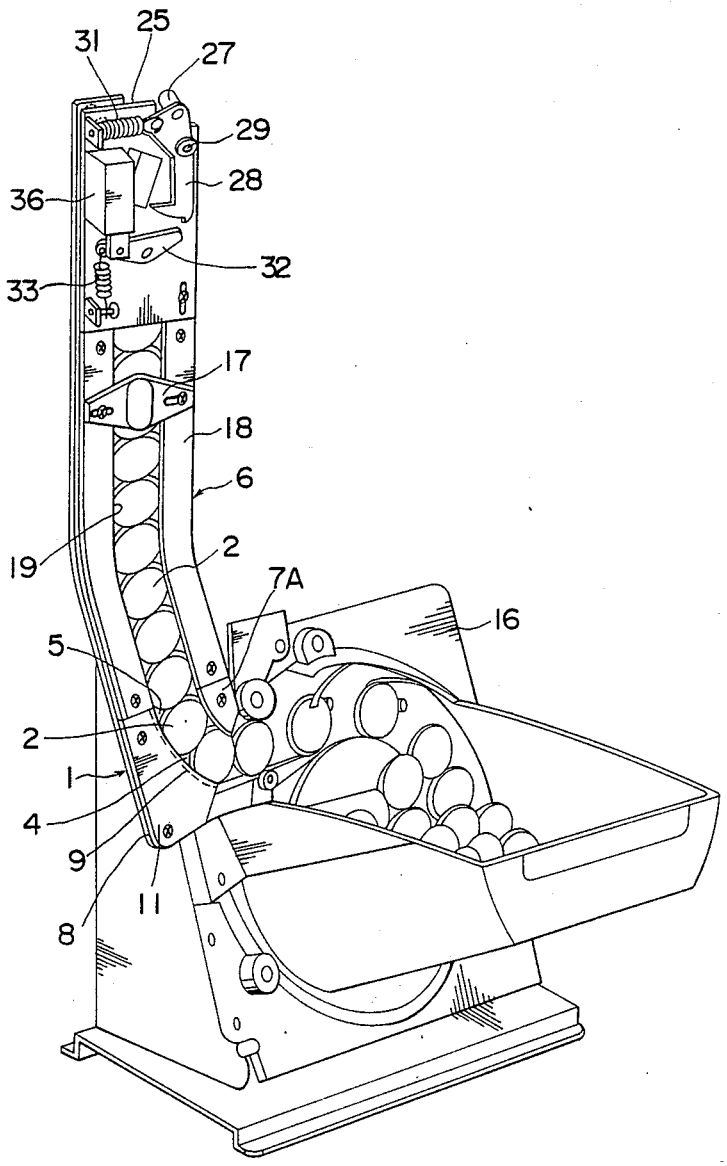
FIG. 3 is a schematic perspective view illustrating a coin payout hopper provided with the outlet chute shown in FIG. 1 according to the invention.
Figure 4:
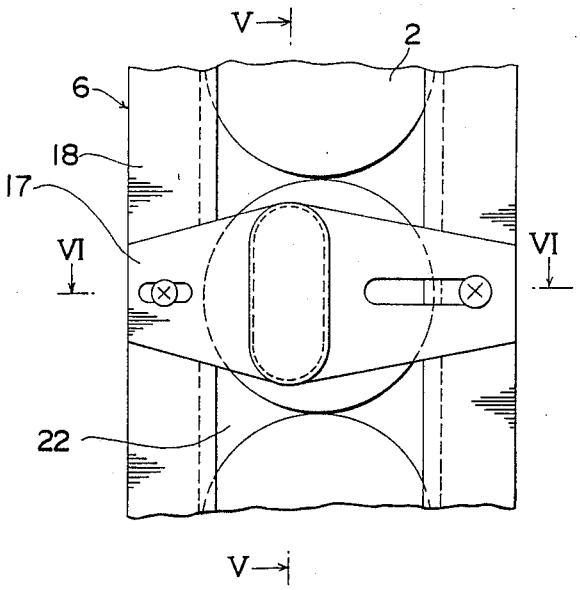
FIG. 4 is an enlarged elevational view of a portion of the escalator shown in FIG. 3 illustrating a coin holding means.
Figure 5:
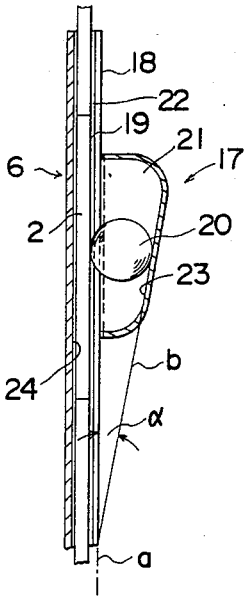
FIG. 5 is a cross-sectional view taken on the line V—V in FIG. 4.
Figure 6:
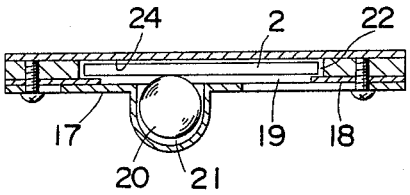
FIG. 6 is a cross-sectional view taken on the line VI—VI in FIG. 4.

Referring to FIG. 3 illustrating a coin payout hopper provided with the outlet chute 1, an escalator 6 is connected to the upper outlet 5 of the outlet chute at the lower end thereof. The escalator 6 is provided with coin retaining means 17 on the front side plate 18 having a window 19. The coin holding means 17 includes a coin holding ball 20 which is vertically movably retained in a ball retaining gutter 21 of the ball retainer. As shown in FIGS. 5 and 6, the ball retaining gutter 21 has a sloped guide wall 23 extending along the longitudinal direction of the escalator at an angle $\alpha$ such as 8°–15°, preferably 10° to the surface "a" of the front side plate 18 to define a ball retaining space which is downwardly constricted.

The coin holding means 17 provided along the escalator permits coins 2 in the coin guiding passage 22 of the escalator 6 to move upwardly when the coins 2 are pushed up by coins discharged from the coin payout hopper since the coin holding ball 20 is also pushed up by the ascending coins and retained in the upper wide portion in the tapered space within the ball retaining gutter 21. The coins are held in the pushed up position in the coin guiding passage 22 by the coin holding ball 20 when the operation of the coin payout hopper is stopped, since the coin holding ball drops in the tapered ball retaining space which is downwardly restricted and a wedging effect is applied to the coin by the coin holding ball 20 to prevent the coin from descending in the coin guiding passage.

It is understood that the coins are held at their pushed up positions in the coin guiding passage by the coin holding ball 20 so that a downward thrust caused by the weight of coins above the coin held by the coin holding ball is supported by the coin holding ball. As a result, the upward thrust required for pushing up the coins in the coin guiding passage is decreased and the tendency of jamming coins in the coin guiding passages of the escalator and of dropping coins out of the outlet chute is remarkably decreased so that it is possible to increase the coin lifting height of the escalator than that of the conventional escalator without jamming of coins.

Figure 7:
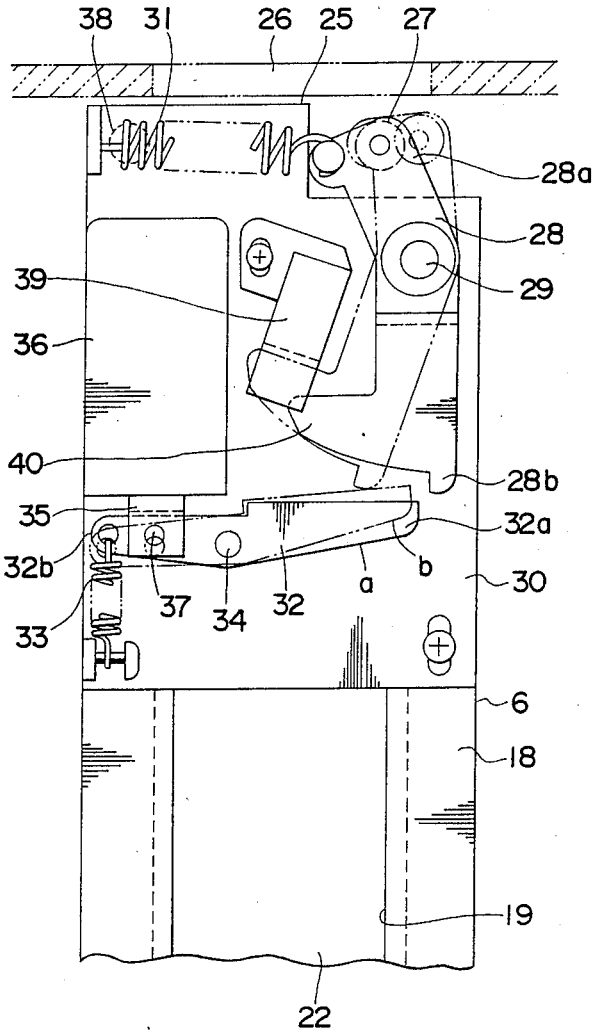
FIG. 7 is an enlarged elevational view of the upper end portion of the escalator shown in FIG. 3.

Referring to FIG. 7, illustrating the upper end portion of the escalator, an upper end outlet 25 is upwardly opened at the top end of the coin guiding passage 22 of the escalator 6 to discharge coins to an inlet 26 of a coin tray. A coin pushing out roller 27 is provided at an upper end **28*a* of a supporting lever 28 which is pivoted at a pivot pin 29 on a side plate 30, secured to the upper end portion of the escalator. The coin pushing out roller 27 is normally positioned in the center of the upper end outlet 25 by resiliently urging the upper end 28***a* of the supporting lever 28 toward the center of the upper end of the escalator by means of a spring 31 and locking the supporting lever 28 by a latch lever 32 engaging with the lower end 28*b* of the supporting lever 28 at one end 32*a* by a spring 33 which can be connected to the other end 32*b*. The supporting lever 28 is pivoted at a pivot pin 34 to the side plate 30 and connected to an actuating rod 35 of an electromagnetic solenoid 36 by means of a pin 37 to release the engagement of the lower end 28*b* and the engaging end 32*b* upon energizing of the solenoid 36 to permit a coin pushed up in the coin guiding passage 22 to displace the pushing up roller 27 from the center position shown by a solid line to a side position shown by a dotted line against the force of the spring 31 and then pass through the upper end outlet 25 between the pushing up roller 27 and a fixed roller 38. When the coin is discharged through the upper end outlet 25, the roller supporting lever 28 is angularly moved about the pivot pin 29 and then a proximity switch 39 of a coin counter is actuated by an arm 40 of the lever 28.

Figure 8:
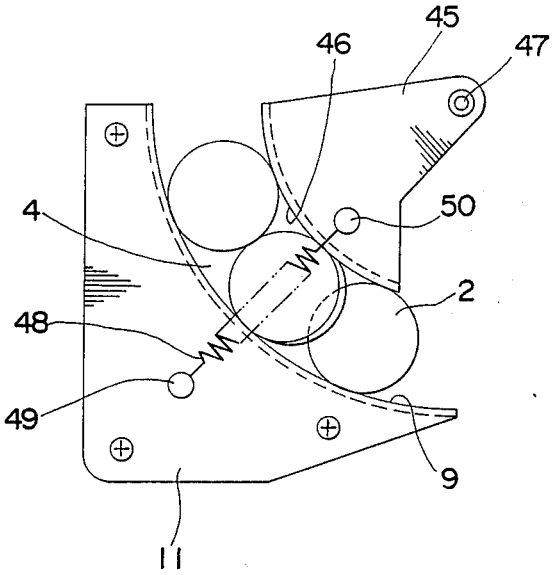
FIG. 8 is an elevational view of a second embodiment of the outlet chute.
Figure 9:
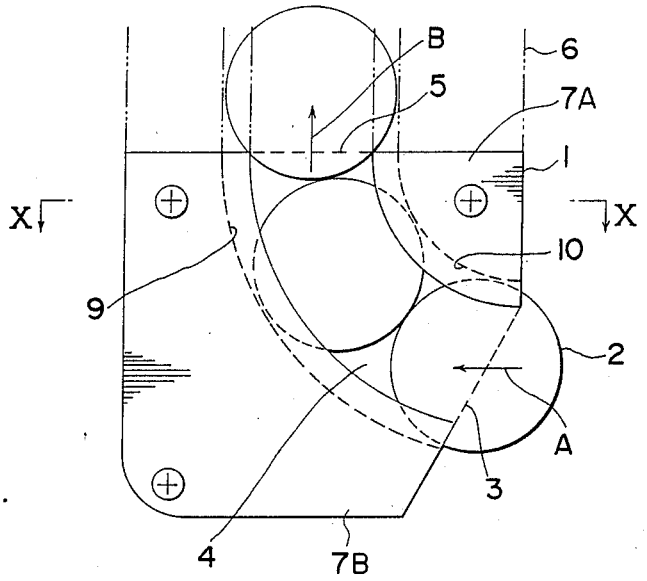
F I G. 9 PRIOR ART
FIG. 9 is an elevational view of a conventional outlet chute.
Figure 10:
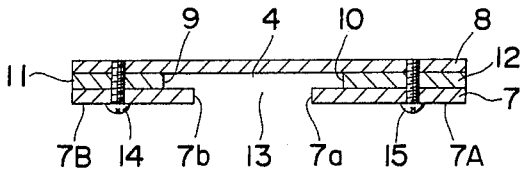
F I G. 10 PRIOR ART
FIG. 10 is a cross-sectional view taken on the line X—X in FIG. 9.

Referring to FIG. 8 illustrating a second embodiment, the outlet chute 1 is composed of a back side plate 8 and a pair of outer and inner edge plates 11 and 45 each of which has an edge face 9, 46 inclined to the back side plate 8. The outer edge plate 11 is fixedly secured to the back side plate 8, while the inner edge plate 45 is rotatably pivoted to the back side plate 8 at the inner end by a pivot pin 47. The movable inner edge plate 45 is connected to the fixed outer guide plate 11 by at least one spring 48 which is connected between a pin 49 on the outer edge plate 11 and a pin 50 on the inner edge plate 45 to contact the edge of the coin 2 in the curved coin guiding passage 4 with both sloped edge faces 9 and 46 of the outer and inner edge plates 11 and 45. Preferably, the thickness of at least the outer guide plate is thinner than that of the coin to be handled.

What is claimed is:

1. An outlet device for coin payout hoppers comprising: an outlet chute having a curved coin guiding passage for upwardly guiding coins pushed in a lower inlet in the horizontal direction towards an upper outlet and an escalator connected to the upper outlet of the outlet chute comprising front and back side plates and a pair of edge plates interposed between side edges of the side plates to define a coin guiding passage upwardly extending from the upper outlet of the curved guiding passage of the outlet chute, said escalator comprising means for holding coins including a ball retaining gutter having a sloped guide wall extending along the coin guiding passage at an acute angle such as 8°–15° with respect to the front side plate and a coin holding ball which is vertically movable in the ball retaining gutter and protrudes from an opening in the front side plate into the coin guiding passage so as to contact a side surface of the coin in the coin guiding passage, to thereby hold the coin by a wedging action of the ball moved downwardly in the sloped guide gutter when the coin tends to descend in the coin guiding passage.

2. The device of claim 1, wherein said outlet chute comprises:

a back side plate;

a pair of inner and outer edge plates secured to opposite edge portions of the back side plate so as to space opposed coin guiding edge faces of the edge plates from each other by a distance corresponding to a diameter of the coin; and a front side plate covering only the inner edge plate positioned at the concave side in relation to a center of curvature of the curved coin guiding passage and having an extension protruding beyond the inner coin guiding edge face of the inner edge plate, at least the edge face of the outer edge plate positioned at the convex side in relation to the center of curvature of the curved coin guiding passage being inclined to the back side plate at an angle.

3. The device of claim 1, wherein the outlet chute comprises a back side plate and a pair of edge plates each of which has a coin guiding edge face inclined to the back side plate, the outer edge plate positioned at the convex side in relation to the center of curvature of the curved coin guiding passage is rigidly fixed to the back side plate, and the inner edge plate positioned at the concave side in relation to the center of curvature of the curved coin guiding passage is rotatably pivoted to the back side plate at a portion of the inner edge plate substantially nearest to the center of curvature of the curved coin guiding passage and connected to the fixed outer edge plate by means of a tension spring secured to an end portion of the inner edge plate substantially furthest from the center of curvature of the curved coin guiding passage.

4. The device of claim 1, wherein the escalator comprises:

an upper end outlet at the top end of the coin guiding passage;

a coin pushing out roller provided at an upper end of a supporting lever pivoted at one side of the passage and resiliently urged toward a closed position at the center of the upper end outlet;

means for latching the roller supporting lever in the closed position of the roller;

an electromagnetic solenoid for releasing the latching means upon operating the payout hopper; and a counter operated by the roller supporting lever.

5. An outlet device for coin payout hoppers comprising an outlet chute having a curved coin guiding passage for upwardly guiding coins pushed in a lower inlet in the horizontal direction towards an upper outlet and an escalator connected to the upper outlet of the outlet chute comprising front and back side plates and a pair of edge plates interposed between side edges of the side plates to define a coin guiding passage upwardly extending from the upper outlet of the curved coin guiding passage of the outlet chute, the outlet chute comprising a back side plate and a pair of outer and inner edge plates each of which has a coin guiding edge face inclined to the back side plate, the outer edge plate positioned at the convex side in relation to the center of curvature of the curved coin guiding passage being rigidly fixed to the back side plate, and the inner edge plate positioned at the concave side in relation to a center of curvature of the curved coin guiding passage being rotatably pivoted to the back side plate at a portion of the inner edge plate substantially nearest to the center of curvature of the curved coin guiding passage and connected to the fixed outer edge plate by means of a tension spring secured to an end portion of the inner edge plate substantially furthest from the center of curvature of the curved coin guiding passage.

* * * * *